United States Patent [19]

Caspar et al.

[11] 4,035,968

[45] July 19, 1977

[54] DEMOUNTABLE BUILDING

[76] Inventors: Raymond Caspar, 37, avenue de la Foret Noire, Strasbourg (Bas-Rhin); Paul-Henri Mathis, 209, rue de la Gare, Muttersholz (Bas-Rhin), both of France

[21] Appl. No.: 611,335

[22] Filed: Sept. 8, 1975

[51] Int. Cl.[2] ..... E04B 1/12

[52] U.S. Cl. ..... 52/63; 52/69; 52/222

[58] Field of Search ..... 52/86, 222, 63, 69; 135/7.1 R, 15 CF, 1 R

[56] References Cited

U.S. PATENT DOCUMENTS

| | | | |
|---|---|---|---|
| 2,650,401 | 9/1953 | Mond | 135/15 CF |
| 2,827,138 | 3/1958 | Roy, Jr. | 52/86 |
| 2,986,150 | 5/1961 | Forian | 135/15 CF X |
| 3,063,104 | 11/1962 | Troxel | 135/1 R |
| 3,388,515 | 6/1968 | Gruettner | 52/222 |
| 3,424,179 | 1/1969 | Minot | 52/63 X |
| 3,535,834 | 10/1970 | Nichols | 52/86 X |
| 3,780,477 | 12/1973 | Sprung, Jr. | 135/15 CF X |

*Primary Examiner*—Ernest R. Purser
*Assistant Examiner*—Carl D. Friedman
*Attorney, Agent, or Firm*—Young & Thompson

[57] ABSTRACT

A demountable building structure comprises a plurality of arches pivoted at their lower ends for vertical swinging movement between raised and lowered positions, and a plurality of flexible transparent plastic sheets extending between and supported by the arches and rendering the space beneath the arches weathertight. The sheets have tension cables along at least one edge thereof, the cables being secured at their opposite ends adjacent the lower ends of the arches. Various embodiments of securement of the sheets to the arches are disclosed.

2 Claims, 4 Drawing Figures

DEMOUNTABLE BUILDING

The present invention is concerned with the field of the construction of buildings, for community or private use, notably halls for sport, for displays, or the like, and has more particularly for one object a removable construction constituted by a framework covered with awnings.

In fact there exist constructions of which the framework is constituted by arches of wood laminated with adhesive, each arch being fixed at its two ends by means of profiled steel plates upon a concrete footing. The connection between two successive arches is obtained by means of shaped cross-bars formed by small beams of wood and fixed upon the arches by means of screws or nails or the like.

The covering of these constructions is in the greater number of cases effected with plates of binding cement fixed upon the arches and the cross-bars. Plates of transparent synthetic material, disposed in a plurality of locations of the covering, ensure natural illumination in the interior of the building during the day.

However, these known constructions have the disadvantage of not being dismantleable, and the natural illumination obtained is often not compatible with that necessary, for example for the practice of a sport, in which case it is necessary, in spite of all, to have recourse to artificial illumination.

The present invention has as an object to mitigate the disadvantages of these known constructions.

The same has, in effect, for its object a removable structure chiefly constituted by a framework formed of arches of wood laminated with adhesive fixed at their ends upon pedestal plates, by cross-bars interconnecting the arches, and by a cover of awnings, preferably of transparent synthetic material.

According to a feature of the invention each end of the arches is provided with a device permitting, on the one hand, the pivoting of these arches during their erection and, on the other hand, their maintenance in the upright position.

In accordance with another feature of the invention the cross-bars are fixed by one of their ends on the arches prior to the erection of the latter, then engage, by the other end, in the upright position of the arches, in means provided for this purpose upon the preceding arch.

According to another feature of the invention the awnings are provided, with a view to their fixing upon the arches, with cables extending in guideways provided for each margin of the awnings.

In conformity with another feature of the invention each arch has, preferably at its middle, and along all of its length, a groove serving as a lodgement for the tension cables of the awnings.

Figure 1:
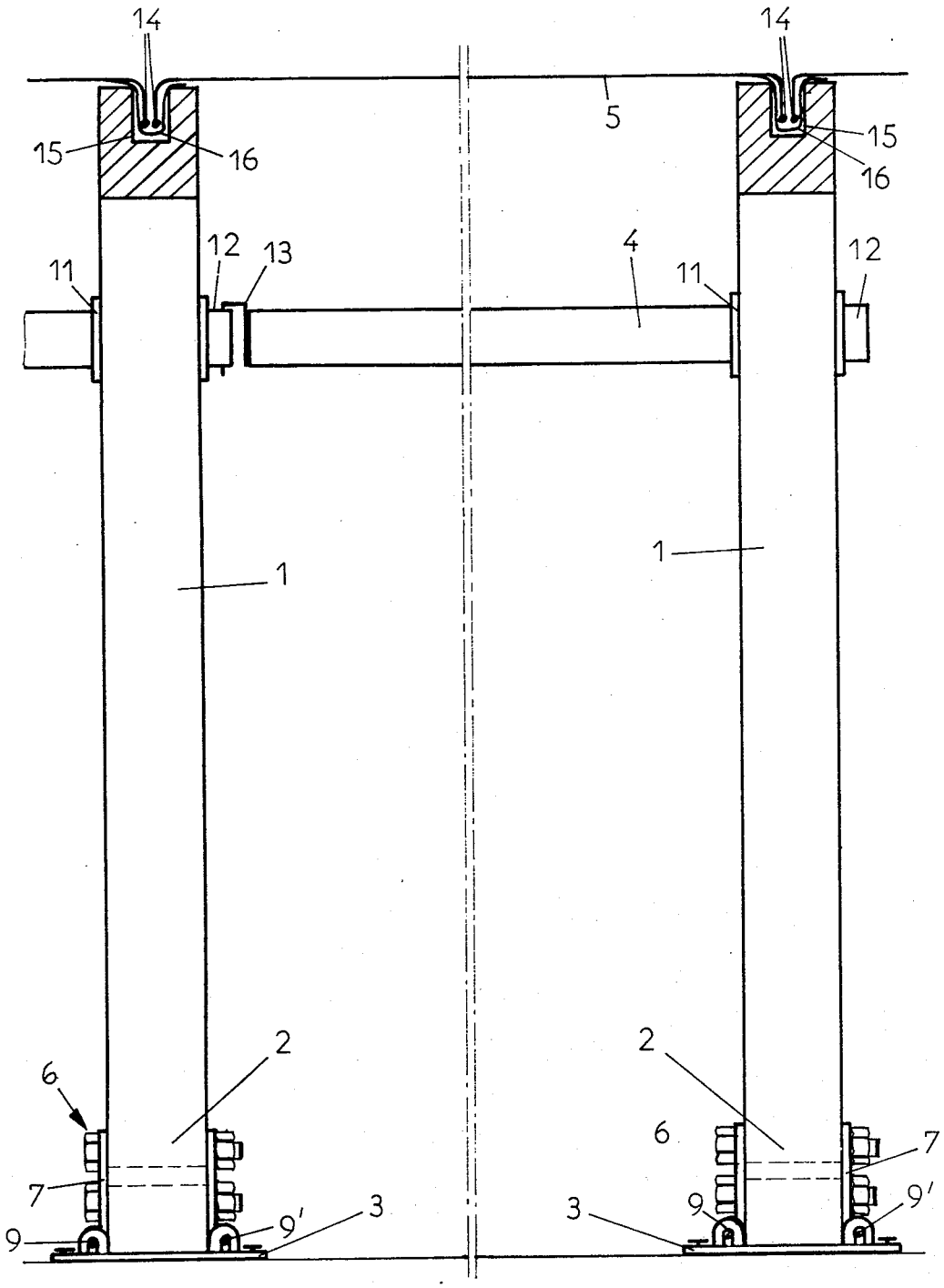
Figure 2:
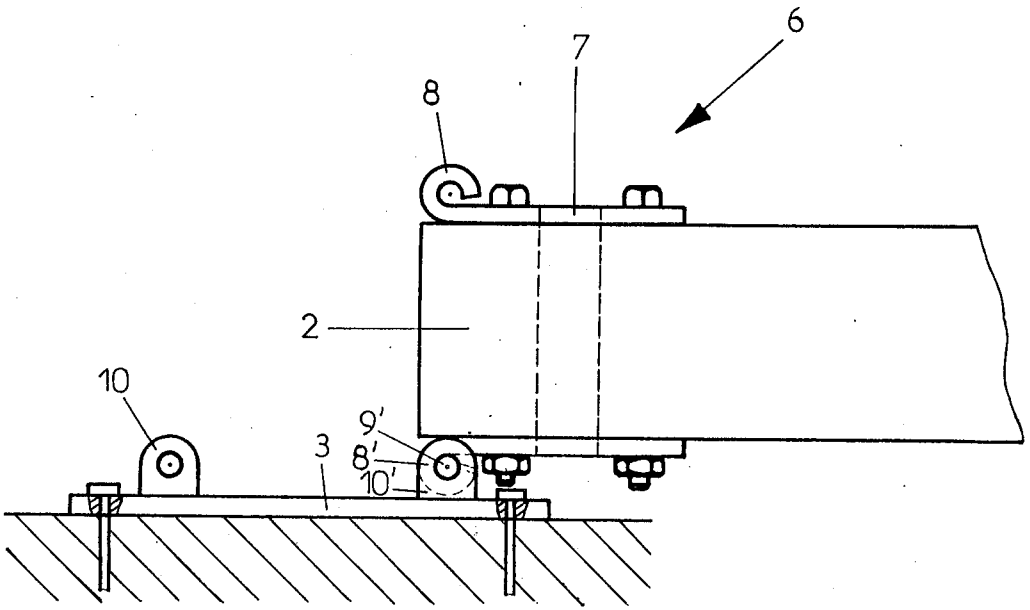
Figure 3:
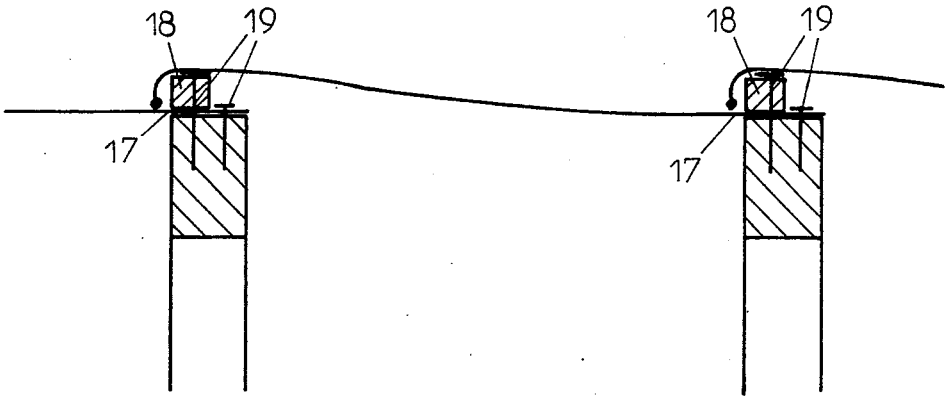
Figure 4:
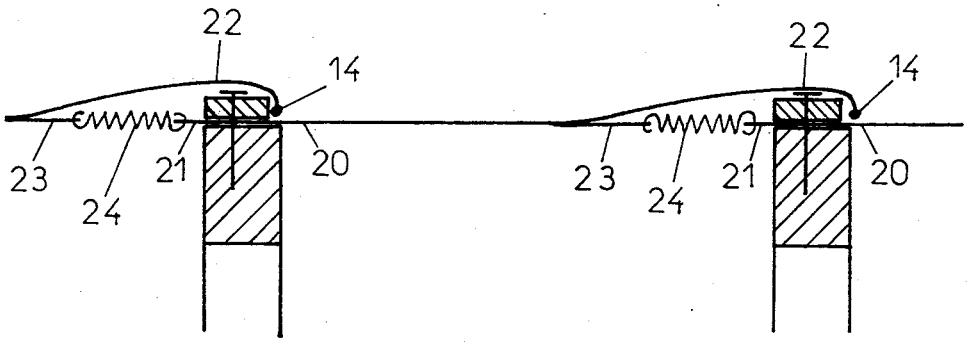

The invention will be better understood with the aid of the following description which relates to preferred manners of embodiment of the invention, given by way of non-limitative example, and explained with reference to the accompanying schematic drawings, in which:

FIG. 1 is a view in elevation and in section of a portion of a structure in accordance with the invention, FIG. 2 is a view in detail, to a larger scale, showing the manner of fixing of the end of an arch to the ground, FIG. 3 is a partial view, in section, showing a modification of construction for the fixing of the awnings, and FIG. 4 is a partial view, in section, of another modification of embodiment for the fixing of the awnings.

In conformity with the invention, and as shown more particularly by FIG. 1, the structure is constituted chiefly by arches 1, for example of wood laminated with adhesive, fixed at their ends 2 upon pedestal plates 3, cross-bars 4 interconnecting the arches, and by a covering of awnings 5, preferably of transparent synthetic material.

The end of each arch 1 is provided with a device 6 constituted by a fastening 7 encircling the end of the arch 1 and comprising two loops 8, 8', and is fixed by means of two gudgeons 9, 9' engaged in the loops and in the lugs 10, 10' provided on the pedestal plate 3 fixed to the ground.

Due to this device 6 co-operating with the pedestal plate 3 it is possible, on the one hand, by disengaging one of the gudgeons to permit the pivoting of the arch (FIG. 2) and, on the other hand, to obtain a stable holding of the arch in the erected position by engagement of the two gudgeons.

According to a further feature of the invention the cross-bars 4, serving to ensure the rigidity of the assembly of the structure and equipped with a fixing plate 11, are fixed upon the arch 1 by means of bolts which are not shown, extending through the arch, and ensuring at the opposite end from the cross-bar 4 the securing of the engagement means 12. At its free end each cross-bar 4 has a hook 13 which, in the upright position of the arch 1, co-operates with the engagement means 12.

According to another feature of the invention the awnings 5 are equipped, at each margin, with guideways in which extend tension cables 14 which are lodged in a groove 15 provided in the middle of the arch 1, and along all its length, and are fixed at the bottoms of the arches to tension devices.

With a view to completing their fixing, the awnings are provided, at the level of the ground, with cables or the like fixed to the feet of the arches or to anchorages sunk in the ground.

In order to ensure tightness at the joints between the awning, each arch has at one of its edges, and along all its length, a flap 16 extending under the tension cables in the groove 15.

According to a modification of embodiment of the invention, represented in FIG. 3, each awning is fixed by one of its ends 17, by means of portions 18 of the arches and by nails 19 or the like, on one arch, the other end, which covers the portion of the arches of the neighbouring arch, being provided with a guideway in which there is a tension cable.

A further modification of embodiment of the invention, represented in FIG. 4, makes it possible to fix one of the edges 20 of the awning upon the arch while allowing passing of a strip 21 provided with fixing holes, the other edge 22 of the awning being provided with a cable 14 and having, turned towards the interior, a flap 23 ensuring, in co-operation with springs 24 hooked in fixing holes, the tension of the awning, the portion of the awning with the cable serving only to ensure tightness upon the arch concerned.

The gable ends of the structures obtained according to the invention are likewise closed by awnings, retained on vertical small beams, and in which there are provided, in the upper portion, apertures for ventilation, and at the level of the ground openings as passageways.

The invention thus permits the obtaining of structures which are easily discountable and which offer a maximum illumination compatible, for example, with the practice of a sport in normal conditions.

More particularly the invention finds its application in the field of the manufacture of dismountable structures serving as halls for display, for sport, or the like.

It is well understood that the invention is not limited to the manner of embodiment described and represented in the accompanying drawings. Modifications remain possible, notably from the point of view of the constitution of the various elements, without departing in any way from the scope of protection of the invention.

What we claim is:

1. Demountable building structure comprising a framework formed of a plurality of arches, crossbars interconnecting the arches, and a cover comprised by a plurality of sheets of flexible weatherproof material, each said sheet having a tension cable along one edge thereof, said tension cable being secured at opposite ends adjacent the bottoms of the arches, the other edge of each sheet being fixed to a said arch and passing beyond said arch in the form of a strip having fixing holes therethrough, the edge of each sheet that has said tension cable also having, turned toward the interior, a flap, and means interconnecting said flap and said strip through said fixing holes, the portion of the sheet with the cable serving only to ensure rain tightness upon the respective arch.

2. A structure as claimed in claim 1, said interconnecting means comprising springs hooked in said fixing holes at one end and connected to said flap at the other end of each spring.

* * * * *